US005730350A

United States Patent [19]

Lin

[11] Patent Number: 5,730,350

[45] Date of Patent: Mar. 24, 1998

[54] MAGAZINE DISPOSED TO A STAPLE TACKER

[75] Inventor: Arlene Lin, Taichung, Taiwan

[73] Assignee: Newco Pneumatic Corp., Taichung, Taiwan

[21] Appl. No.: 709,361

[22] Filed: Sep. 6, 1996

[51] Int. Cl.[6] ..... B25C 1/04

[52] U.S. Cl. ..... 227/120; 227/127

[58] Field of Search ..... 227/120, 126, 227/127

[56] References Cited

U.S. PATENT DOCUMENTS

| | | | |
|---|---|---|---|
| 3,056,137 | 10/1962 | Wandel et al. | 227/127 |
| 3,945,550 | 3/1976 | Monacelli | 227/126 |
| 4,174,802 | 11/1979 | Maestri | 227/127 |
| 4,524,896 | 6/1985 | Morrell, Jr. | 227/127 |
| 5,632,431 | 5/1997 | Lin | 227/120 |

*Primary Examiner*—Scott A. Smith
*Attorney, Agent, or Firm*—Charles E. Baxley, Esq.

[57] ABSTRACT

A magazine of a staple tacker includes a base plate and a cover slidably engaged to the base plate, the base plate having a stop disposed to an inner side thereof, the cover having a ridge extending from an outer surface thereof and an actuator pivotally mounted to the ridge with a spring biasedly disposed between the actuator and the ridge, the actuator having two side plates which extend through corresponding slots defined in the cover to contact the stop, a cap member having an open end for the base plate inserted therethrough and the cover fixedly connected to the cap member such that the cover is positioned relative to the base plate when the two side plates are limited by the stop, a wing portion extending perpendicularly from the cap member and located beside the tail such that the tail can be prevented from being unintentionally pushed.

2 Claims, 4 Drawing Sheets

MAGAZINE DISPOSED TO A STAPLE TACKER

BACKGROUND OF THE INVENTION

1. Field of the Invention

The present invention relates to a magazine disposed to a staple tacker and more particularly, to a magazine having a positioning means to prevent the magazine from being disengaged from the staple tacker unintentionally.

2. Brief Description of the Prior Art

A staple tacker is a handy machine for fastening flooring materials or like together and has a body portion connected to a pneumatic source and a magazine for storing staples therein such that the staples can be ejected from a nose portion of a body portion. Referring to FIGS. 1 and 2, the body portion not shown) having a plate A1 extending downwardly therefrom which has two side flanges extending laterally therefrom so as to define a storing space therein. A curved steel plate A2 is fixedly disposed to an outer side of one of the flanges arid has a protrusion portion A3 extending beyond a distal end of the flange such that a cover A4 is received between the two flanges and staples (not shown) are stored within the storing space between the cover A4 and the plate A1. The cover A4 has a end plate A5 which is positioned by the protrusion portion A3 of the curved steel plate 42 such that the cover A4 is connected to the plate A1. However, such a simple structure which includes only a curved steel plate A2 tends to be pulled intentionally and that will let the cover A4 and the staples so disengaged from the body portion.

FIGS. 3 and 4 show another conventional positioning means to position the magazine to the body portion, the body portion (not shown) has a magazine composed of a fixed portion B1 and a cover B5 which is slidably engaged to a side of the fixed portion B1 so as to store staples (not shown) in a storing space between the cover B5 and the fixed portion B1. The cover B5 has a lower end with a transverse bar B6 extending laterally therefrom and a trigger means is pivotally connected to an outer side of the fixed portion B1, the trigger means has one end B3 being a longitudinal bar and the other end B2 having a hook portion B4 formed thereto. The transverse bar B6 is limited by the hook portion B4 when the cover B5 is engaged to the fixed portion B1. Similarly, because the end B3 is disposed on the outer side of the fixed portion B1 such that the end B3 could be pushed unintentionally.

The present invention intends to provide a magazine disposed to a staple tacker wherein the magazine has a positioning means which can be avoided an unintentional operation so as to mitigate and/or obviate the above-mentioned problems.

SUMMARY OF THE INVENTION

The present invention provides a magazine of a staple tacker and the magazine includes a base plate having a first and and a second, a side wall extending perpendicularly from each one of two longitudinal sides of the base plate for a cover slidably received between the respective groove defined in each one of the two side walls. The base plate has a recess defined near the second end thereof so as to fixedly receive a stop therein.

The cover has a ridge extending from an outer surface thereof and two slots defined in the cover, the two slots located on the opposite sides of the ridge. An actuator has two side plates and a tail extends from a rear end thereof.

The actuator is pivotally mounted to the ridge portion with a spring biasedly disposed between the tail and the ridge portion such that each of the side plates are inserted through the respective slot and a front end of each of the side plates is limited by the stop.

A cap member has an open end for receiving the second end of the base plate and the cover is fixedly connected to the cap member which has a cut-out portion defined in an outer surface thereof such that the two side plates extend through the slots and the cut-out portion to contact the stop. A wing portion extends from the outer surface of the cap member and is located beside the actuator.

It is an object of the present invention to provide a magazine of a staple tacker and has a feature of avoiding from being disengaged from the staple tacker.

Other objects, advantages, and novel features of the invention will become more apparent from the following detailed description when taken in conjunction with the accompanying drawings.

DETAILED DESCRIPTION OF THE PREFERRED EMBODIMENT

Figure 2:
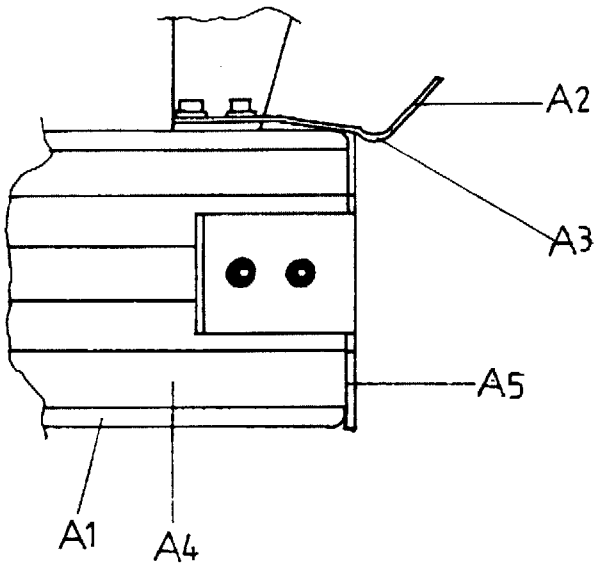
FIG. 2 PRIOR ART
FIG. 2 is an illustrative view to show the first embodiment of the conventional magazine which is slidably engaged with the plate fixedly disposed to the staple tacker.
Figure 1:
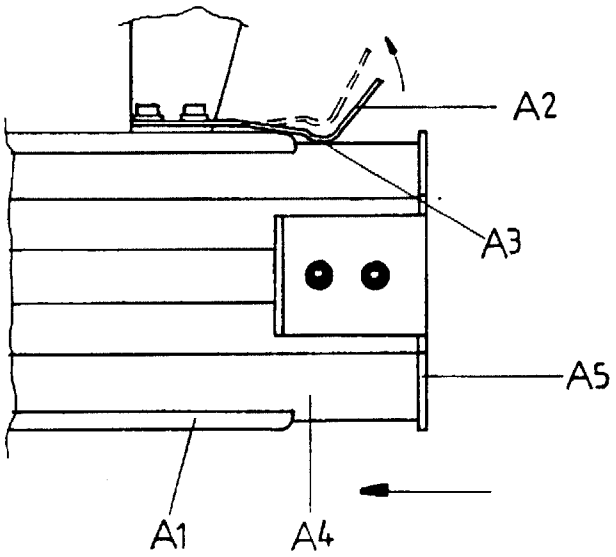
FIG. 1 PRIOR ART
FIG. 1 is an illustrative view to show a first embodiment of a conventional magazine to be slidably engaged with a plate fixedly disposed to a staple tacker.
Figure 4:
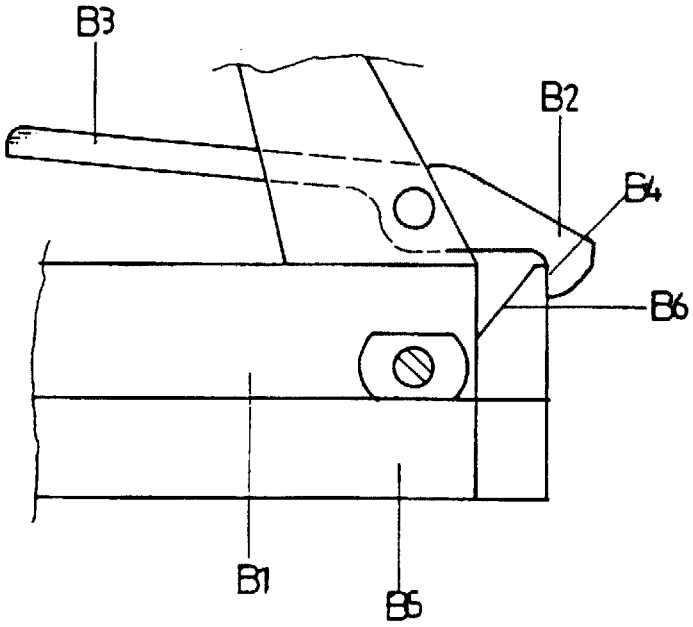
FIG.4 PRIOR ART
FIG. 4 is an illustrative view to show the second embodiment of the conventional magazine which is slidably engaged with the plate fixedly disposed to the staple tacker.
Figure 3:
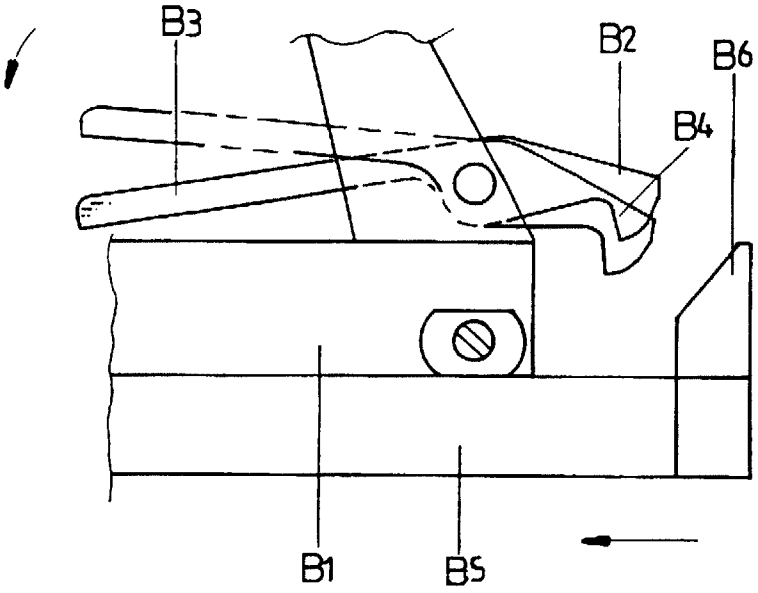
FIG.3 PRIOR ART
FIG. 3 is an illustrative view to show a second embodiment of a conventional magazine to be slidably engaged with a plate fixedly disposed to a staple tacker.
Figure 5:
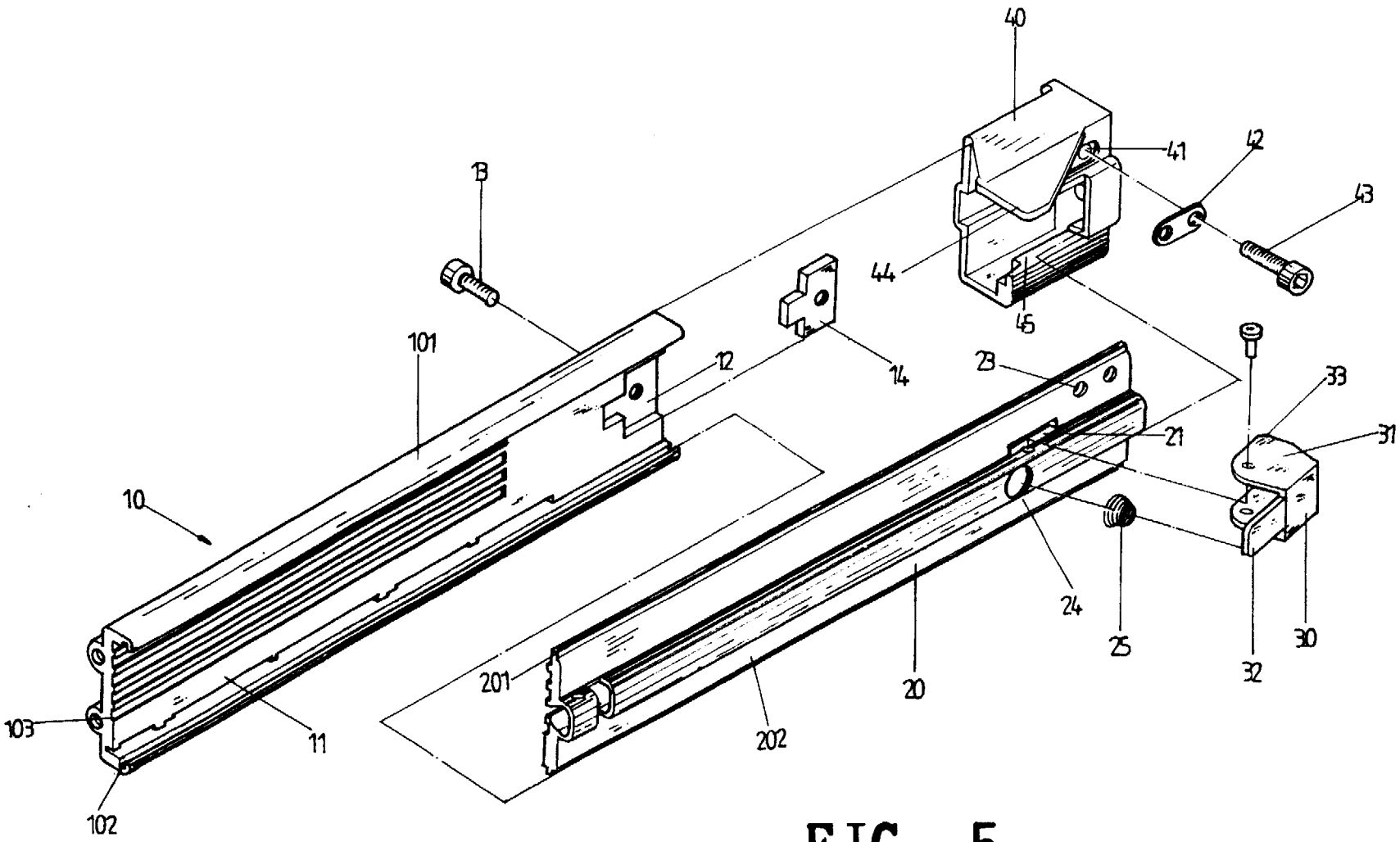
FIG. 5 is an exploded view of a magazine in accordance with the present invention.
Figure 6:
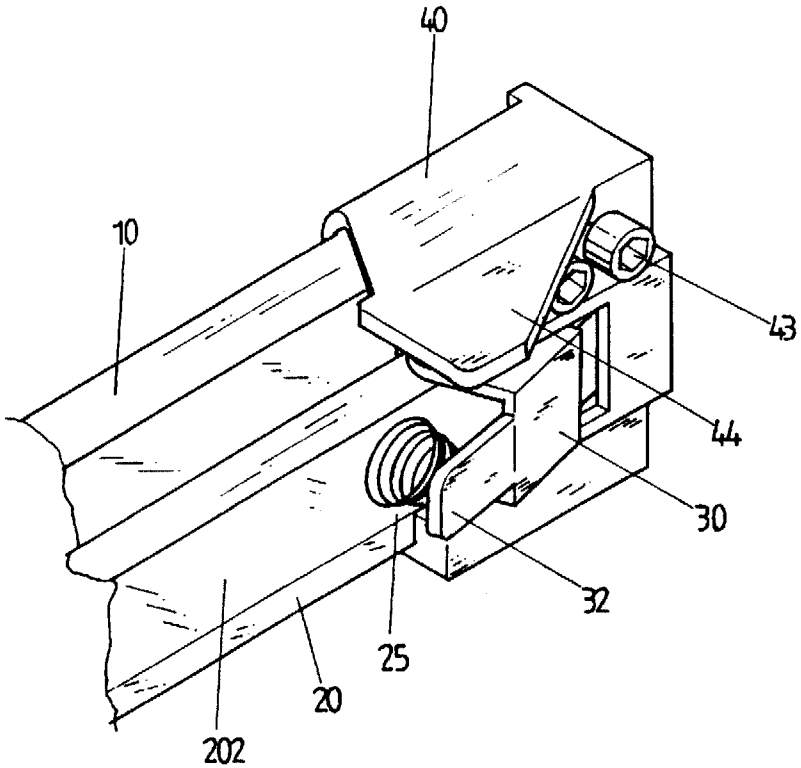
FIG. 6 is a perspective view of a portion of the magazine in accordance with the present invention.
Figure 7:
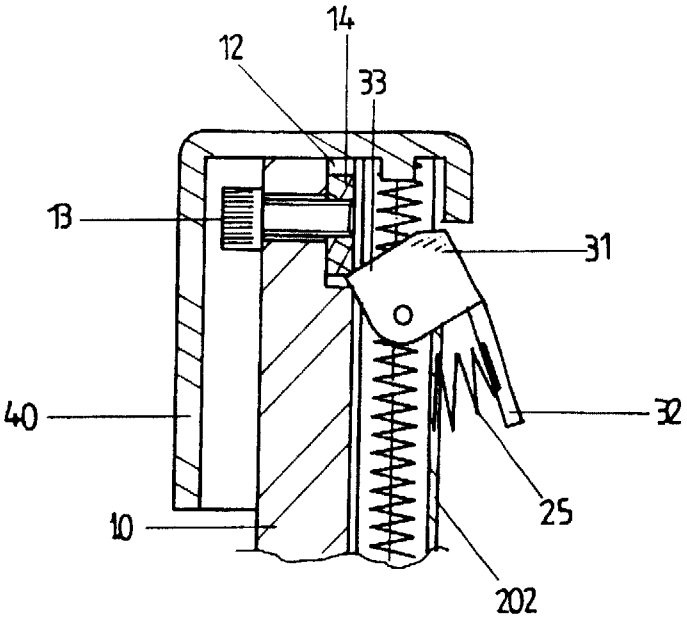
FIG. 7 is a side elevational view, partly in section, of the magazine to show how the cover is positioned relative to the base plate.

Referring to FIGS. 5 through 7, a magazine in accordance with the present invention generally includes a base plate 10 which has a first end fixedly connected to a staple tacker (not shown) and a second, a side wall 101 extending perpendicularly from each one of two longitudinal sides of the base plate 10, each one of the side walls 101 having a groove 102 defined in an inner side thereof. The base plate 10 has a recess 12 defined in a bottom surface thereof and is located near the second end of the base plate 10 so as to fixedly receive a stop 14 therein by a bolt 13 wherein the stop 14 protrudes higher than the bottom surface 11. The base plate 10 has a plurality of longitudinal slots 103 defined in the bottom surface thereof for receiving staples (not shown) therein.

A cover 20 has a flange 201 extending laterally from each one of two sides thereof so as to be slidably received in the groove 102 of the base plate 10. The cover 20 has a ridge 202 extending from an outer surface thereof and two slots 21 are defined in the cover 20 and the two slots 21 are located on the opposite sides of the ridge 202. The ridge 202 has a first hole 24 defined therein and has two threaded holes 23 defined therein located on one side of the ridge 202.

An actuator 30 being a U-shaped element has two side plates 31 and a tail 32 extends from a rear end of the actuator 30. The actuator 30 is pivotally mounted to the ridge 202 with a spring 25 biasedly disposed between the tail 32 and an outer surface of the ridge 202 wherein one end of the spring 25 is securely received in the first hole 24 such that each of the side plates 31 insert through the respective slot 21 and a front end 33 of each of the side plates 31 is limited by the stop 14.

A cap member 40 has an open end for receiving the second end of the base plate 10 and the cover 20 therein. The cover 20 is fixedly connected to the cap member 40 by extending two bolts 43 through a washer 42, two holes defined in an outer surface of the cap member 40 and being threadedly engaged with the respective threaded hole 23 of the cover 20. The cap member 40 bas a cut-out portion 45 defined in the outer surface thereof such that the two side plates 31 extend through the slots 21 and the cut-out portion 45 to contact the stop 14 with the front ends thereof so as to position the cover 20 relative to the base plate 10. A wing portion 44 extends from the outer surface of the cap member 40 and is located beside the actuator 30 wherein the wing portion 44 extends higher than the tail 32 in a direction perpendicular to the outer surface of the ridge 202.

Accordingly, the cover 20 is easily to be engaged to the base plate 10 by operating the actuator 30, that is to say, the tail 32 is operated to engage or to disengage the cover 20 to or from the base plate 10. Any unintentional action on the tail 32 will be suitably controlled because the wing portion 44 of the cap member 40.

Although the invention has been explained in relation to its preferred embodiment, it is to be understood that many other possible modifications and variations can be made without departing from the spirit and scope of the invention as hereinafter claimed.

What is claimed is:

1. A magazine disposed to a staple tracker, said magazine comprising:

a base plate having a first end and a second, a side wall extending perpendicularly from each one of two longitudinal sides of said base plate, each one of said side walls having a groove defined in an inner side thereof, said base plate having a recess defined near said second end thereof so as to fixedly receive a stop therein;

a cover having a flange extending laterally from each one of two sides thereof so as to be slidably received said corresponding groove of said base plate, said cover having a ridge extending from an outer surface thereof and two slots defined in said cover, said two slots located on the opposite sides of said ridge;

an actuator having two side plates and a tail extending from a rear end thereof, said actuator pivotally mounted to said ridge with a spring biasedly disposed between said tail and an outer surface of said ridge such that each of said side plates are inserted through said respective slot and a front end of each of said side plates is limited by said stop, and a cap member having an open end for receiving said second end of said base plate and said cover being fixedly connected to said cap member which has a cut-out portion defined in an outer surface thereof such that said two side plates extend through said slots and said cut-out portion to contact said stop, a wing portion extending from said outer surface of said cap member and located beside said actuator.

2. The magazine as claimed in claim 1 wherein the wing portion extends higher than said tail in a direction perpendicular to said outer surface of said ridge.

* * * * *